US005941429A

United States Patent [19]

Koons

[11] Patent Number: 5,941,429

[45] Date of Patent: Aug. 24, 1999

[54] EXTENDABLE HANGER

[75] Inventor: Charles R. Koons, 1339 E. Main St., Palmyra, Pa. 17078

[73] Assignee: Charles R. Koons, Palmyra, Pa.

[21] Appl. No.: 09/032,930

[22] Filed: Mar. 2, 1998

[51] Int. Cl.[6] ..... A47G 25/44

[52] U.S. Cl. ..... 223/94; 223/89; 223/85

[58] Field of Search ..... 223/85, 92, 89, 223/94

[56] References Cited

U.S. PATENT DOCUMENTS

| | | | |
|---|---|---|---|
| D. 324,781 | 3/1992 | Uke . | |
| 779,062 | 1/1905 | Beatty | 223/94 |
| 2,519,276 | 8/1950 | Needles et al. | 223/94 |
| 2,652,958 | 9/1953 | Alvord | 223/94 |
| 3,254,814 | 6/1966 | Weir et al. | 223/94 |
| 4,949,739 | 8/1990 | Ryan . | |
| 4,978,043 | 12/1990 | Uke . | |
| 5,056,693 | 10/1991 | DeBoe . | |
| 5,163,590 | 11/1992 | Lawler . | |
| 5,718,358 | 2/1998 | Long et al. | 223/94 |

*Primary Examiner*—Bibhu Mohanty

[57] ABSTRACT

An extendable hanger (10) having a central body (12) which has a central body top (12T) and a central body bottom (12A) and a central body front (12F) and a central body back (12B) and a central body right member (12R) having at least one central body right member indent therein and a central body left member (12L) having at least one central body left member indent therein. A hollow right extender (14R) is slidably positioned on the central body right member (12R). The hollow right extender (14R) further has at least one extender ratchet positioned on an inside surface complimentary to the at least one central body right member indent. The at least one extender ratchet functions to engage the at least one central body right member indent holding the hollow right extender (14R) in a set position on the central body right member (12R). A hollow left extender (14L) is slidably positioned on the central body left member (12L). The hollow left extender (14L) further has at least one extender ratchet positioned on an inside surface complimentary to the at least one central body left member indent. The at least one extender ratchet functions to engage the at least one central body left member indent holding the hollow left extender (14L) in a set position on the central body left member (12L). A holder (16) attached to the central body top (12T) extending upwardly therefrom which functions to permit hanging.

5 Claims, 3 Drawing Sheets

EXTENDABLE HANGER

BACKGROUND OF THE INVENTION

1. Field of the Invention

The present invention relates to garment hangers. More particularly, the present invention relates to a garment hanger for wet suits which position the wet suit to promote faster and complete drying.

2. Description of the Prior Art

Dry suits and wetsuits must be dried before storing. To adequately dry a wet or dry suit the suit must be drained and air must be circulated throughout the interior to dry any remaining water. The weight of the suits tends to distort and misshape the suits when hung from a conventional hanger. Further, because the hanger is very narrow the interior side of the suits tend to come together preventing drying thoroughly. Some suits dry better when hung upside down and others when upside right. Prior art hangers address only one orientation and in the upside down position tend to distort the leg cuffs. What is needed is a wet and dry suit hanger which keeps the suit open to air flow and is adapted to permit hanging the suit upside down or upside right. Further, a hanger is needed which does not distort the suit in either position. With the new design suits, having a zipperless entry, the hanger must be expandable to force the suit entry point open to permit air flow.

Numerous innovations for an extendable hanger have been provided in the prior art that are described as follows. Even though these innovations may be suitable for the specific individual purposes to which they address, they differ from the present invention as hereinafter contrasted.

In U.S. Pat. No. 5,163,590, titled Specialized Aquatic Gear Hanger, invented by William M. Lawler and Raul J. Jaquez, the present invention is a specialized aquatic gear hanger comprising a detachable swivel hook and a multiple plane hanger frame which has two parallel vertical panels connected at their upper ends by a horizontal bridge member. The first vertical plane has an aquatic sport suit retaining member for retaining an aquatic sport suit such as a wetsuit or a drysuit. The second vertical panel has a central vertical beam and a lower horizontal beam, two aquatic sport glove retaining members upwardly and outwardly extending respectively from the two lateral ends of the lower horizontal beam for retaining aquatic sport gloves, two aquatic sport boot retaining members upwardly then outwardly extending respectively from the lower horizontal beam between the central vertical beam and the two aquatic sport glove retining members for retaining aquatic sport booties, and an aquatic sport utility article retaining member extending below the lower horizontal beam for retaining aquatic sport utility articles such as a hood, a mask, fins, towels and other accessories. The present invention is a specialized aquatic sports gear hanger which is preferably made of molded polypropylene material.

The patented invention differs from the present invention because the patented invention is a device to hang a dry suit up for drying and has a feature to hold gloves, boots, and head covering. The present invention is a simpler device which has the added feature of hanging a dry suit upside down.

In U.S. Pat. No. D324,781, titled Hanger for Wetsuit Accessories or the Like, invented by Alan K. Uke, the ornamental design for a hanger for wetsuit accessories or the like, is as shown.

The patented invention differs from the present invention because the patented invention is an ornamental design for a hanger for wetsuit accessories. The present invention does not have ornamental features similar to the patented invention.

In U.S. Pat. No. 5,056,693, titled Garment Hanger for Wetsuit with Removable Drying Rods, invented by Thomas S. DeBoe, a garment drying hanger includes a body member slidably receiving an adjustable hook member therein and defining a plurality of openings for removably receiving a plurality of rods upon which wet surf boots, surf gloves and the like can be positioned for drying. A cage-like structure, substantially in the shape of human shoulders, is attached to and is suspended beneath the body member for supporting a scuba wet suit or the like in a position for drying, and the rods can be stored within the cage-like structure when the rods are not in use.

The patented invention differs from the present invention because the patented invention is a cage-like structure, substantially in the shape of human shoulders for supporting a scuba wet for drying. The patented invention further has rods to support accessories such as gloves, boots, and head coverings. The cage permits air to flow therethrough for drying. The present invention is a unique means for hanging a dry suit in such a way that it may drain and air is permitted to circulate to the interior to dry the interior spaces. Further the present invention has a feature to hang a dry suit upside down.

In U.S. Pat. No. 4,978,043, titled Hanger for Wetsuit Accessories and the Like, invented by Alan K. Uke, the present invention is a device for supporting wetsuit accessories such as gloves, booties and hoods for drying and storage. The hanger comprises a hook having an elongated neck coupled thereto with a crossbar coupled to the neck opposite the hook. A pair of outer fingers are each coupled to a respective end of the crossbar with each outer finger extending in a direction toward the hook. A pair of inner fingers are each respectively coupled to the crossbar on opposite sides of the neck intermediate of a respective outer finger with each extending in an upward direction toward the hook. An arm is coupled to the crossbar and has a portion extending in a spaced apart relationship therefrom opposite the neck and fingers.

The patented invention differs from the present invention because the patented invention is a device for supporting wetsuit accessories such as gloves, booties and hoods for drying and storage. The present invention is a unique means for hanging a dry suit in such a way that it may drain and air is permitted to circulate to the interior to dry the interior spaces. Further the present invention has a feature to hang a dry suit upside down.

In U.S. Pat. No. 4,949,739, titled Wetsuit Washing Hanger Device, invented by Francis D. Ryan, a wetsuit washing hanger includes a pair of hollow laterally extending arms for supporting a wetsuit by its shoulder area. The hollow interior of the arms communicate with an integral funnel into which water from a shower head from which the device is suspended may be directed. Apertures in the side walls of the hollow arms enable a washing liquid to spray onto the interior of the wetsuit.

The patented invention differs from the present invention because the patented invention is a device to hang a wetsuit from a shower head so that it can be rinsed and cleaned. Means for hanging from an alternative location is not disclosed. The shower head inserted into the patented invention water is disbursed through openings in the hanger portion. The patented invention does not have a means for hanging a suit upside down.

Numerous innovations for an extendable hanger have been provided in the prior art that are adapted to be used. Even though these innovations may be suitable for the specific individual purposes to which they address, they would not be suitable for the purposes of the present invention as heretofore described.

SUMMARY OF THE INVENTION

The present invention is a unique means for hanging a dry suit in such a way that it may drain and air is permitted to circulate to the interior to dry the interior spaces. Further the present invention has a feature to hang a dry suit upside down. The present invention has an attachment means functioning to removably fasten the present invention to a hook, bar or other hanging means. A tubular horizontal bar is securely and rotationally attached at top a midpoint. The tubular bar is of sufficient diameter to keep the dry suit open when inserted through the neck opening. Further, if the bar is of varying width then a dry suit may be positioned such that air can circulate through the dry suit. The present invention is adapted to receive the lower portion of a dry suit, (ie: the feet or leg hem) so that the dry suit may be hung upside down.

The types of problems encountered in the prior art are suspending wet and dry suits so that the interior quickly and thoroughly drys.

In the prior art, unsuccessful attempts to solve this problem were attempted namely: various hangers which were too narrow and lacked an expansion feature.

Innovations within the prior art are rapidly being exploited because there is a need for rapid drying of wet and dry suits.

The present invention solved a long felt need for a hanger which permit circulation of air throughout the interior of a wet and dry suits.

A synergistic effect was produced utilizing the present invention due to the following facts and results from experimentation: hanging a wet and dry suit on the present invention results in little distortion of the material resulting in an improved fit.

Accordingly, it is an object of the present invention to provide a central body having a holder swivally attached to the top thereof.

More particularly, it is an object of the present invention to provide a right extender and left extender which are hollow and function to spread the suit apart.

In keeping with these objects, and with others which will become apparent hereinafter, one feature of the present invention resides, briefly stated, in a plurality of right extender end openings and left extender end openings which permit air to flow into the suit interior.

When the extendable hanger is designed in accordance with the present invention, wet and dry suits are hung for drying right side up or upside down.

In accordance with another feature of the present invention, a right extender rear ratchet and a left extender front ratchet function to expand the suit openings and permit air to enter the interior.

Another feature of the present invention is that a plurality of central body cones position the openings of the dry and wet suit to enhance air flow.

Yet another feature of the present invention is that a plurality of central body right channel permit air to enter the suit through the right and left extenders.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

LIST OF REFERENCE NUMERALS UTILIZED IN THE DRAWINGS

10—extendable hanger (10)
12—central body (12)
12T—central body top (12T)
12TA—central body top opening (12TA)
12TU—central body top upper groove (12TU)
12TM—central body top middle groove (12TM)
12TL—central body top lower groove (12Th)
12F—central body front (12F)
12FR—central body front right cone (12FR)
12FL—central body front left cone (12FL)
12B—central body back (12B)
12BR—central body back right cone (12BR)
12BL—central body back left cone (12BL)
12A—central body bottom (12A)
12AA—central body bottom cup (12AA)
12CR—central body right channel (12CR)
12CL—central body left channel (12CL)
12R—central body right member (12R)
12RF—central body right front member (12RF)
12RFA—central body right front member indent (12RFA)
12RR—central body right rear member (12RR)
12RRA—central body right rear member indent (12RRA)
12L—central body left member (12L)
12LF—central body left front member (12LF)
12LFA—central body left front member indent (12LFA)
12LR—central body left rear member (12LR)
12LRA—central body left rear member indent (12LRA)
14R—right extender (14R)
14RF—right extender front (14RF)
14RFA—right extender front ratchet (14RFA)
14RR—right extender rear (14RR)
14RRA—right extender rear ratchet (14RRA)
14RA—right extender end (14RA)
14RAA—right extender end opening (14RAA)
14RUR—right extender upper right convex member (14RUR)
14RLR—right extender lower right convex member (14RLR)
14RUL—right extender upper left convex member (14RUL)
14RLL—right extender lower left convex member (14RLL)
14L—left extender (14L)
14LF—left extender front (14LF)
14LFA—left extender front ratchet (14LFA)
14LR—left extender rear (14LR)
14LRA—left extender rear ratchet (14LRA)
14LA—left extender end (14LA)
14LAA—left extender end opening (14LAA)
14LUR—left extender upper right convex member (not shown)
14LLR—left extender lower right convex member (not shown)
14LUL—left extender upper left convex member (not shown)
14LLL—left extender lower left convex member (not shown)
16—holder (16)
16A—holder hook (16A)
16B—holder shaft (16B)

DESCRIPTION OF THE PREFERRED EMBODIMENT

Figure 1:
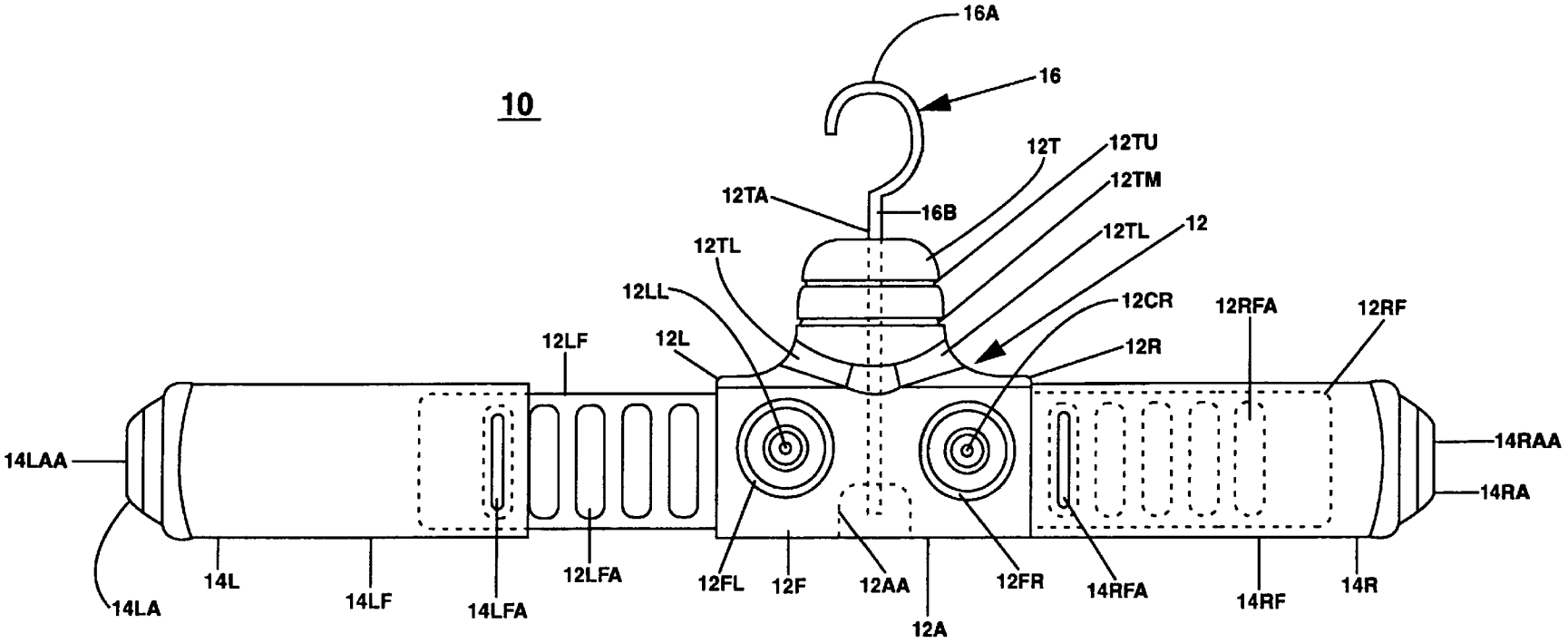
FIG. 1 is a front view of an extendable hanger.

Firstly, referring to FIG. 1 which is a front view of an extendable hanger (10). The extendable hanger (10) comprises a central body (12) which comprises a central body top (12T) and a central body bottom (12A) and a central body front (12F) and a central body back (12B) and a central body right member (12R) and a central body left member (12L). The central body right member (12R) comprises a central body right front member (12RF) having at least one central body right front member indent (12RFA) therein and a central body right rear member (12RR) having at least one central body right rear member indent (12RRA) therein. The central body left member (12L) comprises a central body left front member (12LF) having at least one central body left front member indent (12LFA) therein and a central body left rear member (12LR) having at least one central body left rear member indent (12LRA) therein. The central body front (12F) comprises at least one central body front cone therein which functions to provide a space for drainage and increased air flow thereby decreasing drying time. The at least one central body front cone comprises a central body front right cone (12FR) and a central body front left cone (12FL). The central body front right cone (12FR) and the central body back right cone (12BR) are connected by, a central body right channel (12CR). The central body front left cone (12FL) and the central body back left cone (12BL) are connected by a central body left channel (12CL). The central body back (12B) comprises at least one central body back cone therein which functions to provide a space for drainage and increased air flow thereby decreasing drying time. The at least one central body back cone comprises a central body back right cone (12BR) and a central body back left cone (12BL).

The central body top (12T) comprises a central body top opening (12TA) therethrough The central body top (12T) further comprises at least one grove selected from a group consisting of central body top upper groove (12TU), central body top middle groove (12TM) and central body top lower groove (12TL), the central body top grooves (12TU, 12TM, 12TL) function to provide a space for drainage and increased air flow thereby decreasing drying time.

The extendable hanger (10) further comprises a hollow right extender (14R) slidably positioned on the central body right member (12R). The hollow right extender (14R) comprises at least one extender ratchet positioned on an inside surface complimentary to the at least one central body right member indent. The right extender (14R) further comprises a right extender front (14RF) having at least one right extender front ratchet (14RFA) positioned on an inner surface thereof and a right extender rear (14RR) having at least one right extender rear ratchet (14RRA) positioned on an inner surface thereof. The right extender (14R) still further comprises at least one right extender convex member selected from a group consisting of right extender upper right convex member (14RUR), right extender lower right convex member (14RLR), right extender upper left convex member (14RUL), and right extender lower left convex member (14RLL). The at least one extender ratchet functions to engage the at least one central body right member indent holding the hollow right extender (14R) in a set position on the central body right member (12R). The hollow right extender (14R) is securely attached to a right extender end (14RA). The right extender end (14RA) comprises a right extender end opening (14RAA) therein which functions to provide increased air flow thereby decreasing drying time.

The extendable hanger (10) further comprises a hollow left extender (14L) slidably positioned on the central body left member (12L). The hollow left extender (14L) comprises at least one extender ratchet positioned on an inside surface complimentary to the at least one central body left member indent. The left extender (14L) further composes a left extender front (14LF) having at least one left extender front ratchet (14LFA) positioned on an inner surface thereof and a left extender rear (14LR) having at least one left extender rear ratchet (14LRA) positioned on an inner surface thereof. The at least one extender ratchet functions to engage the at least one central body left member indent holding the hollow left extender (14L) in a set position on the central body left member (12L). The hollow left extender (14L) is securely attached to a left extender end (14LA). The left extender end (14LA) comprises a left extender end opening (14LAA) therein which functions to provide increased air flow thereby decreasing drying time. The left extender (14L) further comprises at least one left extender convex member selected from a group consisting of left extender upper right convex member (not shown), left extender lower right convex member (not shown), left extender upper left convex member (not shown), and left extender lower left convex member (not shown).

The extendable hanger (10) further comprises a holder (16) attached to the central body top (12T) extending upwardly therefrom. The holder (16) comprises a holder shaft 16B) positioned within the central body top opening (12TA). The holder shaft (16B) is rotatably positioned within the central body top opening (12TA). The holder (16) further comprises a holder hook (16A). The holder shaft (16B) terminates in a recessed central body bottom cup (12AA) positioned within the central body bottom (12A).

The extendable hanger (10) is manufactured from a material selected from a group consisting of plastic, plastic composite, rubber, rubber composite, wood, wood composite, metal, metal alloy, fiberglass, epoxy, and carbon-graphite.

Figure 2:
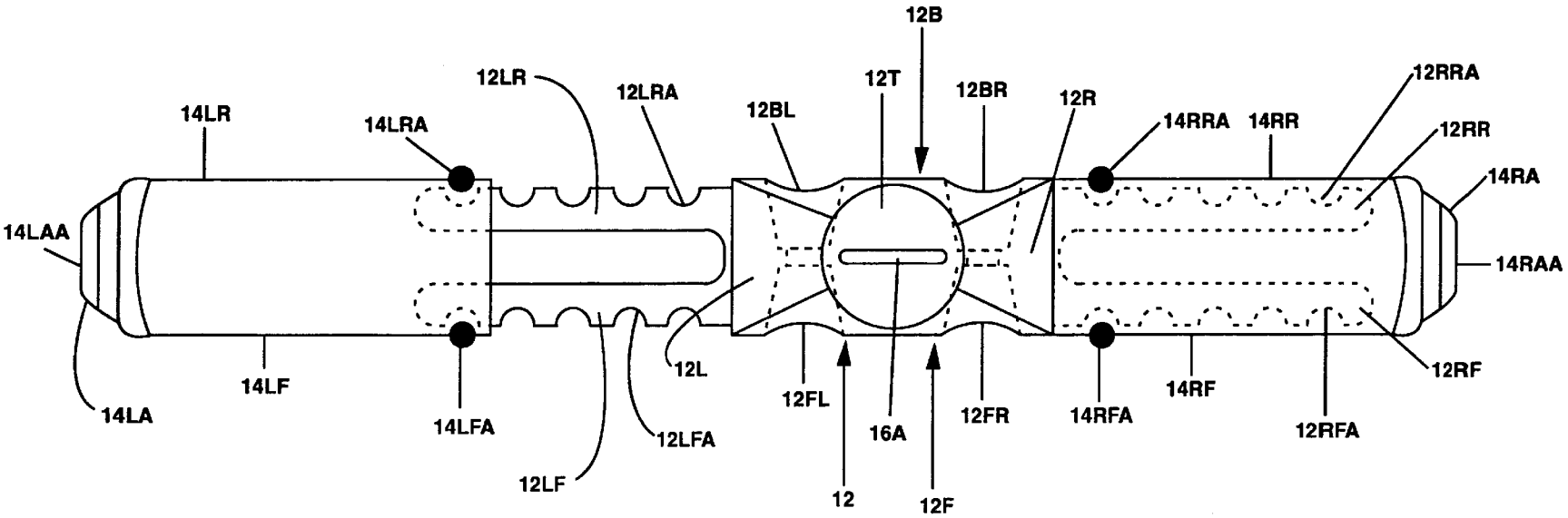
FIG. 2 is a top view of an extendable hanger.

Secondly, referring to FIG. 2 which is a top view of an extendable hanger (10). The extendable hanger (10) comprises a central body (12) which comprises a central body top (12T) and a central body front (12F) and a central body back (12B) and a central body right member (12R) and a central body left member (12L). The central body right member (12R) comprises a central body right front member (12RF) having at least one central body right front member indent (12RFA) therein and a central body right rear member (12RR) having at least one central body right rear member indent (12RRA) therein. The central body left member (12L) comprises a central body left front member (12LF) having at least one central body left front member indent (2LFA) therein and a central body left rear member (12LR) having at least one central body left rear member indent (12LRA) therein. The central body front (12F) comprises at least one central body front cone therein which functions to provide a space for drainage and increased air flow thereby decreasing drying time. The at least one central body front cone comprises a central body front right cone (12FR) and a central body front left cone (12FL). The central body back (12B) comprises a central body back right cone (12BR) and a central body back left cone (12BL).

The extendable hanger (10) further comprises hollow right extender (14R) slidably positioned on the central body right member (12R). The hollow right extender (14R) comprises a right extender front (14RF) having at least one right extender front ratchet (14RFA) positioned on an inner surface thereof and a right extender rear (14RR) having at least one right extender rear ratchet (14RRA) positioned on an inner surface thereof The right extender (14R) still further comprises at least one right extender convex member selected from a group consisting of right extender upper right convex member (14RUR), right extender lower right convex member (14RLR), right extender upper left convex member (14RUL), and right extender lower left convex member (14RLL). The at least one extender ratchet functions to engage the at least one central body right member indent holding the hollow right extender (14R) in a set position on the central body right member (12R). The hollow right extender (14R) is securely attached to a right extender end (14RA). The right extender end (14RA) comprises a right extender end opening (14RAA) therein which functions to provide increased air flow thereby decreasing drying time.

The extendable hanger (10) further comprises a hollow left extender (14L) slidably positioned on the central body left member (12L). The hollow left extender (14L) comprises at least one a left extender front (14LF) having at least one left extender front ratchet (14LFA) positioned on an inner surface thereof and a left extender rear (14LR) having at least one left extender rear ratchet (14LRA) positioned on an inner surface thereof. The at least one extender ratchet functions to engage the at least one central body left member indent holding the hollow left extender (14L) in a set position on the central body left member (12L). The hollow left extender (14L) is securely attached to a left extender end (14LA). The left extender end (14LA) comprises a left extender end opening (14LAA) therein which functions to provide increased air flow thereby decreasing drying time. The left extender (14L) further comprises at least one left extender convex member selected from a group consisting of left extender upper right convex member (not shown), left extender lower right convex member (not shown), left extender upper left convex member (not shown), and left extender lower left convex member (not shown).

The extendable hanger (10) further comprises a holder (16) attached to the central body top (12T) extending upwardly therefrom. The holder (16) comprises a holder shaft (16B) positioned within the central body top opening (12TA). The holder shaft (16B) is rotatably positioned within the central body top opening (12TA). The holder (16) further comprises a holder hook (16A). The holder shaft (16B) terminates in a recessed central body bottom cup (12AA) positioned within the central body bottom (12A).

The extendable hanger (10) is manufactured from a material selected from a group consisting of plastic, plastic composite, rubber, rubber composite, wood, wood composite, metal, metal alloy, fiberglass, epoxy, and carbon-graphite.

Figure 3:
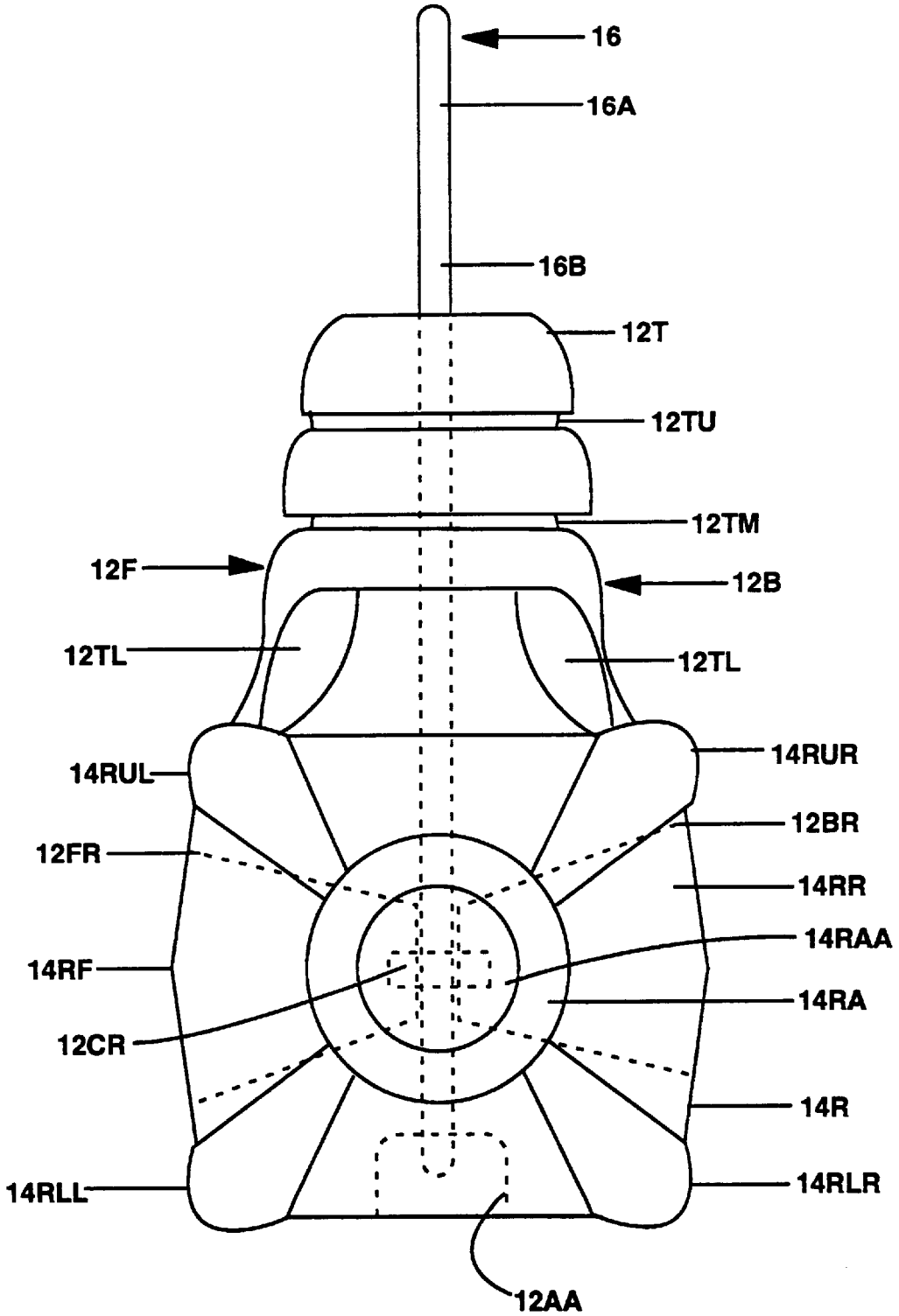
FIG. 3 is a right end view of an extendable hanger.

Lastly, referring to FIG. 3 which is a right end view of an extendable hanger (10). The extendable hanger (10) comprises a central body (12) which comprises a central body top (12T) and a central body front (12F) and a central body back (12B).

The central body top (12T) comprises at least one grove selected from a group consisting of central body top upper groove (12TU), central body top middle groove (12TM) and central body top lower groove (12TL), the central body top grooves (12TU, 12TM, 12TL) function to provide a space for drainage and increased air flow thereby decreasing drying time.

The extendable hanger (10) further comprises a hollow right extender (14R)which comprises a right extender rear (14RR) having at least one right extender rear ratchet (14RRA) positioned on an inner surface thereof. The right extender (14R) still further comprises at least one right extender convex member selected from a group consisting of right extender upper right convex member (14RUR), right extender lower right convex member (14RLR), right extender upper left convex member (14RUL), and right extender lower left convex member (14RLL). The at least one extender ratchet functions to engage the at least one central body right member indent holding the hollow right extender (14R) in a set position on the central body right member (12R). The hollow right extender (14R) is securely attached to aright extender end (14RA). The right extender end (14RA) comprises a right extender end opening (14RAA) therein which functions to provide increased air flow thereby decreasing drying time.

The extendable hanger (10) further comprises a holder (16) attached to the central body top (12T) extending upwardly therefrom. The holder (16) comprises a holder shaft (16B). The holder (16) further comprises a holder hook (16A).

It will be understood that each of the elements described above, or two or more together, may also find a useful application in other types of constructions differing from the type described above.

While the invention has been illustrated and described as embodied in an extendable hanger, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

What is claimed is:

1. An extendable hanger (10) comprising:

A) a central body (12) which comprises a central body top (12T) and a central body bottom (12A) and a central body front (12F) and a central body back (12B) and a central body right member (12R) having at least one central body right member indent therein and a central body left member (12L) having at least one central body left member indent therein, the central body top (12T) comprises a central body top opening (12TA) therethrough and a holder (16) comprises a holder shaft (16B) positioned within the central body top opening (12TA), the holder shaft (16B) is rotatably positioned within the central body top opening (12TA), the central body top (12T) further comprises at least one grove selected from a group consisting of central body top upper groove (12TU), central body top middle groove (12TM) and central body top lower groove (12TL), the central body top grooves (12TU, 12TM, 12TL) function to provide a space for drainage and increased air flow thereby decreasing drying time, the central body front (12F) comprises at least one central body front cone therein which functions to provide a space for drainage and increased air flow thereby decreasing drying time, the at least one central body front cone comprises a central body front right cone (12FR) and a central body front left cone (12FL), the central body back (12B) comprises at least one central body back cone therein which functions to provide a space for drainage and increased air flow thereby decreasing drying time, the at least one central body back cone comprises a central body back right cone (12BR) and a central body back left cone (12BL), the central body right member (12R) comprises a central body right front member (12RF) having at least one central body right front member indent (12RFA) therein and a central body right rear member (12RR) having at least one central body right rear member indent (12RRA) therein, the central body left member (12L) comprises a central body left front member (12LF) having at least one central body left front member indent (12LFA) therein and a central body left rear member (12LR) having at least one central body left rear member indent (12LRA) therein;

B) a hollow right extender (14R) slidably positioned on the central body right member (12R), the hollow right extender (14R) further comprises at least one extender ratchet positioned on an inside surface complimentary to the at least one central body right member indent, the at least one extender ratchet functions to engage the at least one central body right member indent holding the hollow right extender (14R) in a set position on the central body right member (12R), the right extender (14R) comprises a right extender front (14RF) having at least one right extender front ratchet (14RFA) positioned on an inner surface thereof and a right extender rear (14RR) having at least one right extender rear ratchet (14RRA) positioned on an inner surface thereof, the left extender (14L) comprises a left extender front (14LF) having at least one left extender front ratchet (14LFA) positioned on an inner surface thereof and a left extender rear (14LR) having at least one left extender rear ratchet (14LRA) positioned on an inner surface thereof, the right extender end (14RA) having a right extender end opening (14RAA) therein which functions to provide increased air flow thereby decreasing drying time, the left extender end (14LA) having a left extender end opening (14LAA) therein which functions to provide increased air flow thereby decreasing drying time;

C) a hollow left extender (14L) slidably positioned on the central body left member (12L), the hollow left extender (14L) further comprises at least one extender ratchet positioned on an inside surface complimentary to the at least one central body left member indent, the at least one extender ratchet functions to engage the at least one central body left member indent holding the hollow left extender (14L) in a set position on the central body left member (12L); and D) the holder (16) attached to the central body top (12T) extending upwardly therefrom, the holder (16) further comprises a holder hook (16A), the holder shaft (16B) terminates in a recessed central body bottom cup (12AA) positioned within the central body bottom (12A).

2. The extendable hanger (10) as described in claim 1, wherein the central body front right cone (12FR) and the central body back right cone (12BR) are connected by a central body right channel (12CR) and the central body front left cone (12FL) and the central body back left cone (12BL) are connected by a central body left channel (12CL).

3. The extendable hanger (10) as described in claim 1, wherein the right extender (14R) further comprises at least one right extender convex member selected from a group consisting of right extender upper right convex member (14RUR), right extender lower right convex member (14RLR), right extender upper left convex member (14RUL), and right extender lower left convex member (14RLL).

4. The extendable hanger (10) as described in claim 1, wherein the left extender (14L) further comprises at least one left extender convex member selected from a group consisting of left extender upper right convex member left extender lower right convex member left extender upper left convex member, and left extender lower left convex member.

5. The extendable hanger (10) as described in claim 1 is manufactured from a material selected from a group consisting of plastic, plastic composite, rubber, rubber composite, wood, wood composite, metal, metal alloy, fiberglass, epoxy, and carbon-graphite.

* * * * *